United States Patent [19]

Morrison et al.

[11] Patent Number: 4,831,677

[45] Date of Patent: May 23, 1989

[54] SPONGE MOP

[75] Inventors: Keith Morrison, Suffield; Robert B. Staubitz, Avon; William H. Valls, Harwinton, all of Conn.; Peter MacDonald, Reading, Mass.

[73] Assignee: Kellogg Bush Manufacturing Co., Easthampton, Mass.

[21] Appl. No.: 222,545

[22] Filed: Jul. 21, 1988

Related U.S. Application Data

[63] Continuation-in-part of Ser. No. 117,986, Nov. 11, 1987, abandoned.

[51] Int. Cl.[4] ..... A47L 13/146

[52] U.S. Cl. ..... 15/119 A; 15/244.1

[58] Field of Search ..... 15/119 A, 244 R, 116 A

[56] References Cited

U.S. PATENT DOCUMENTS

| | | | |
|---|---|---|---|
| 2,730,744 | 1/1956 | Vaughn | 15/119 A |
| 2,883,689 | 4/1959 | Vosbikian et al. | 15/119 A |
| 2,892,201 | 6/1959 | Peterson et al. | 15/119 A |
| 2,967,317 | 1/1961 | Richards | 15/119 A |
| 3,806,982 | 4/1974 | Park | 15/119 A |
| 4,044,419 | 8/1977 | Robinson | 15/119 A |
| 4,468,830 | 9/1984 | Batchelor | 15/119 A |

*Primary Examiner*—Chris K. Moore

*Attorney, Agent, or Firm*—Ross, Ross & Flavin

[57] ABSTRACT

A mop of the "butterfly" type has a flat sponge releasably secured to the lower faces of a pair of base plates mounted for pivotal movement relative to the mop handle, a slide is telescopically sleeved on the handle, a yoke-shaped compression member is pivoted to the slide and slidable relative to the handle and base plates in a camming motion as the slide is moved relative to the handle causing the base plates to pivot relative to the handle to force the sponge into a U-shaped, folded, or face-to-face position to compress the sponge and extract liquid therefrom.

3 Claims, 3 Drawing Sheets

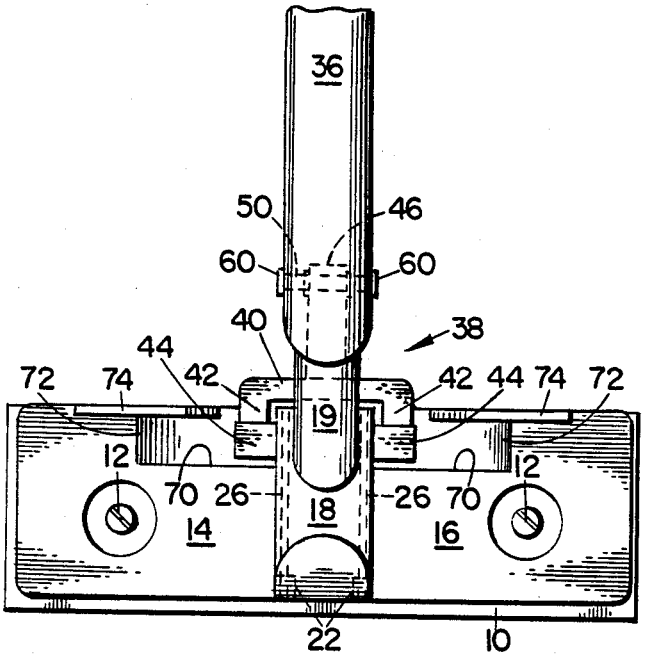
FIG. 2.
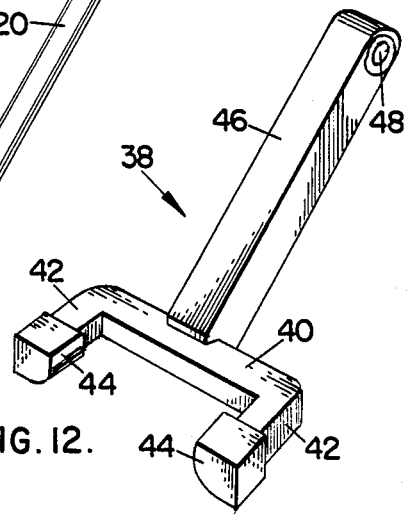
FIG. 12.
FIG. 13.
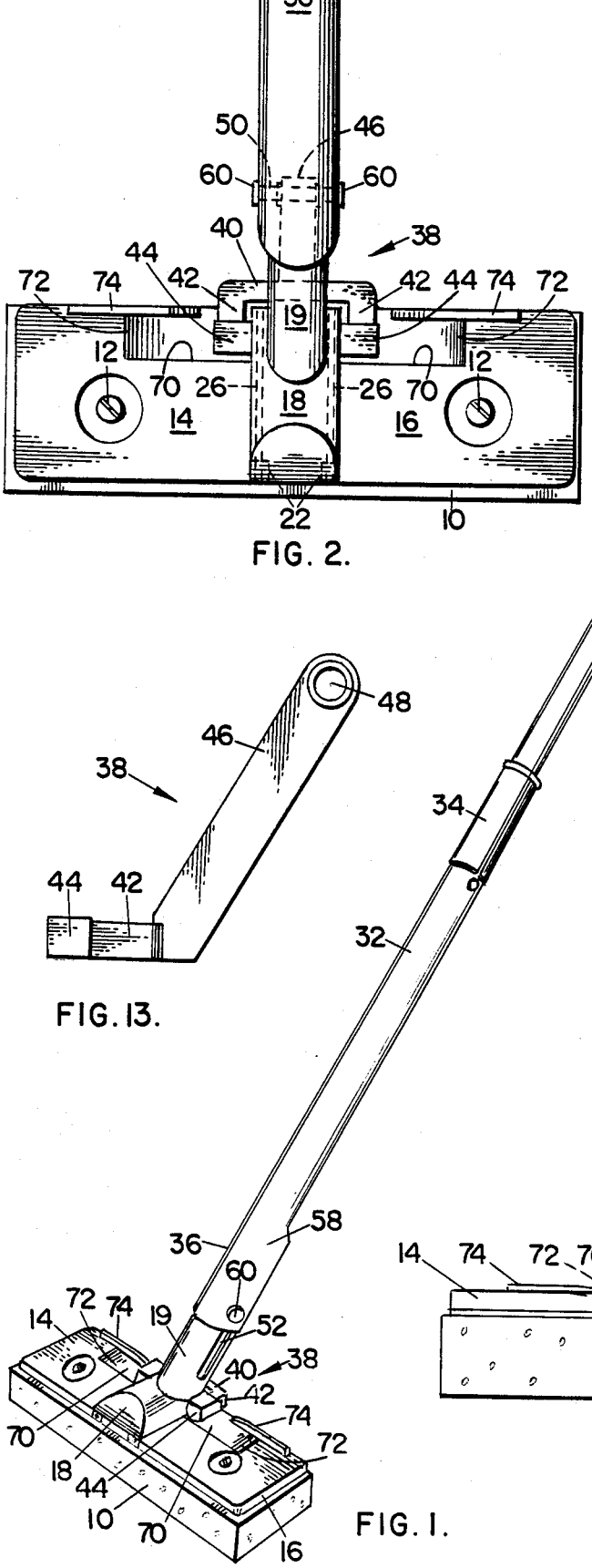
FIG. 1.
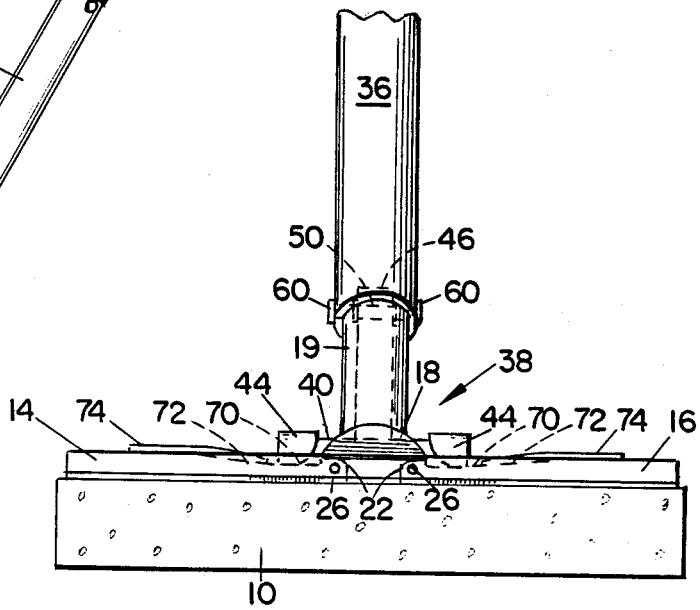
FIG. 3.

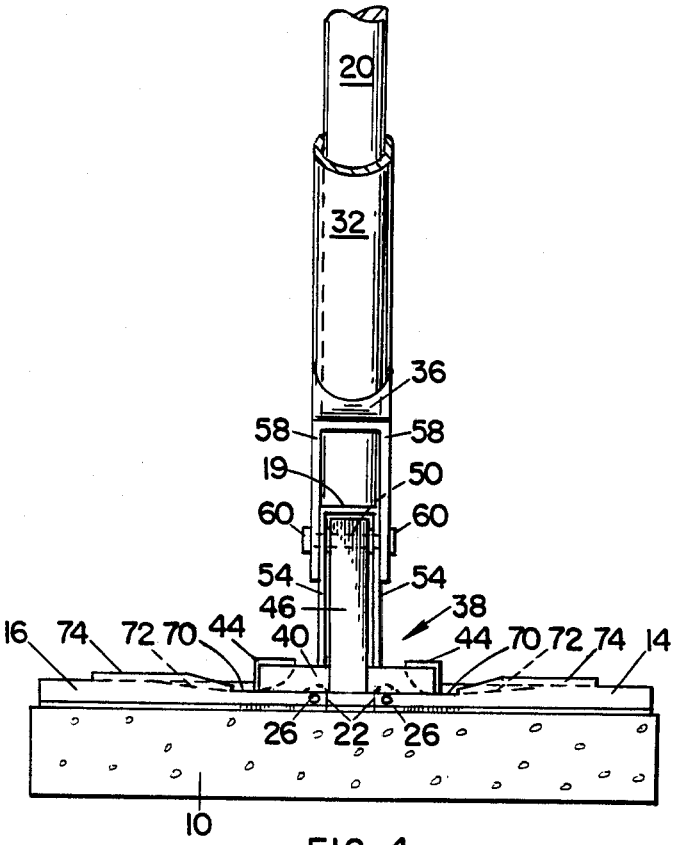
FIG. 4.
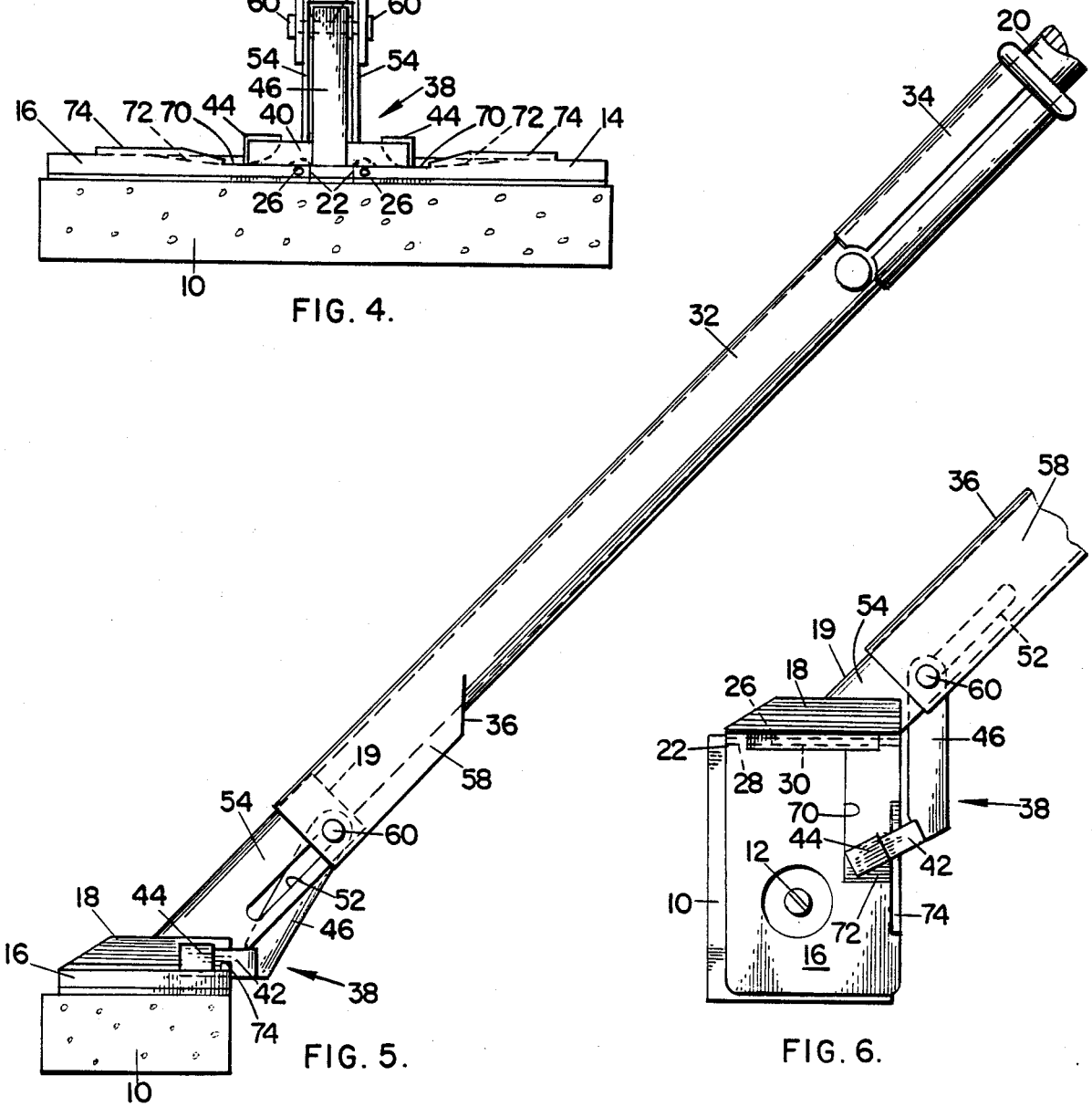
FIG. 5.
FIG. 6.

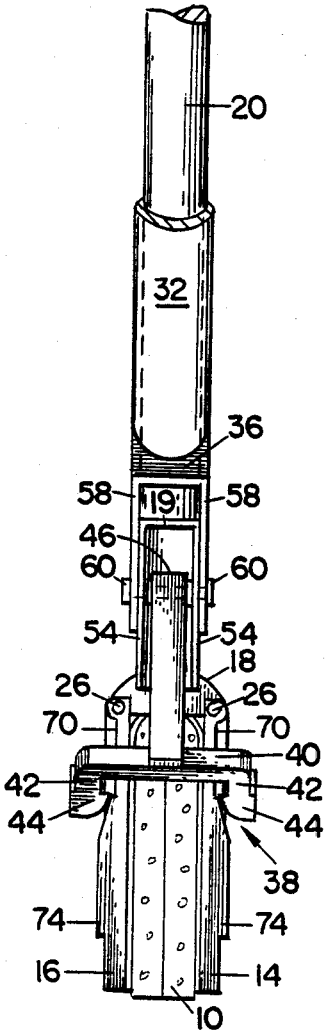
FIG. 7.
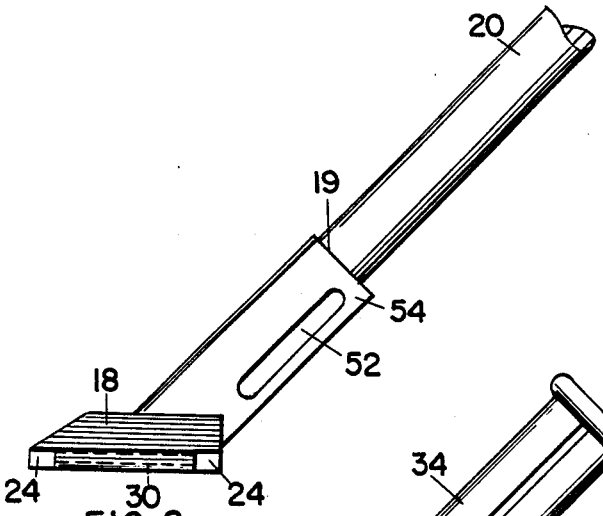
FIG. 8.
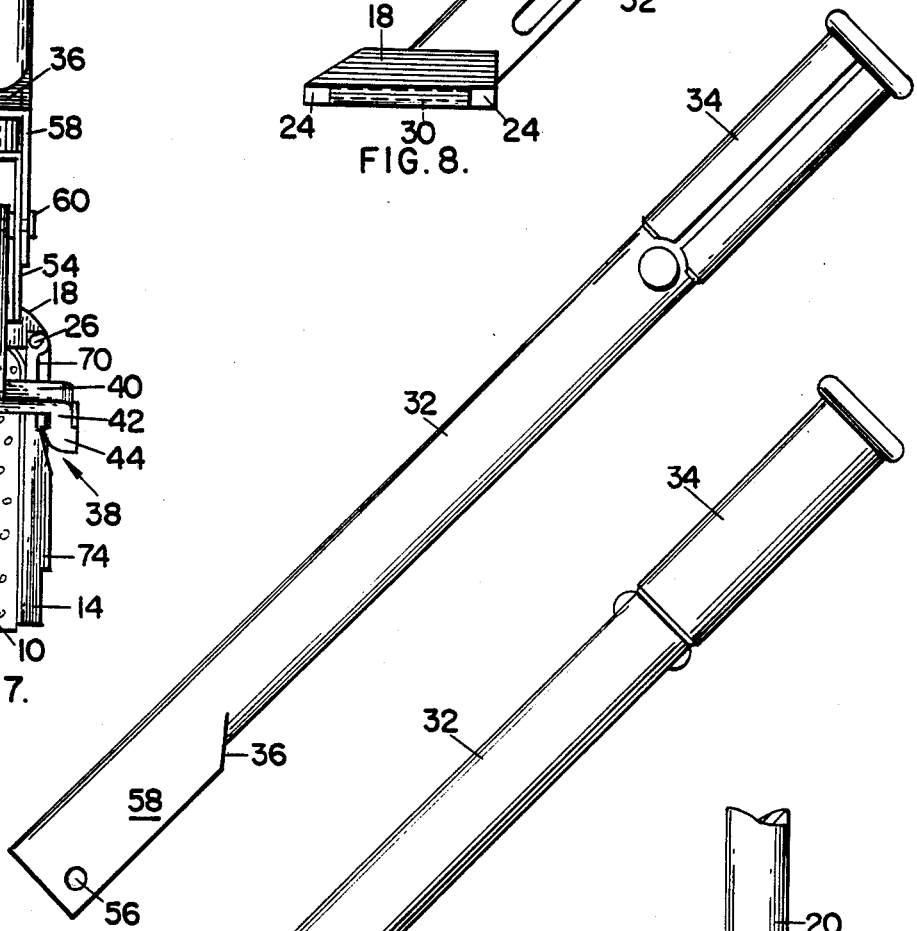
FIG. 10.
FIG. 11.
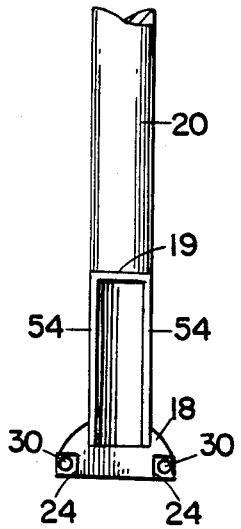
FIG. 9.

SPONGE MOP

This is a continuation-in-part of application Ser. No. 07/117,986 filed Nov. 11, 1987 now abandoned.

BACKGROUND OF THE INVENTION

1. Field of the Invention

The invention relates to sponge mops, and more particularly to sponge mops of the foldable or so-called butterfly type, wherein the sponge may be folded into a U-shape and the sponge squeezed to express liquid therefrom.

2. Description of Related Art

A wide variety of prior art sponge mop structures exists. However, virtually all are expensive, complicated in their structures and difficult or unreliable in their operation.

SUMMARY OF THE INVENTION

The sponge mop of the invention is relatively inexpensive, simple in structure, easy to operate and extremely reliable in its operation.

BRIEF DESCRIPTION OF THE DRAWINGS

FIG. 1 is a front perspective view of a sponge mop embodying the invention;

FIG. 2 is a fragmentary view in top plan;

FIG. 3 is a fragmentary view in front elevation;

FIG. 4 is a fragmentary view in rear elevation;

FIG. 5 is a fragmentary view in side elevation;

FIG. 6 is a fragmentary view in side elevation with the compression means in a sponge compressing position;

FIG. 7 is a fragmentary elevational view, as seen from the right of FIG. 6, with the compression means in the sponge compressing mode;

FIG. 8 is a fragmentary view in side elevation of the integral handle and base of the sponge mop;

FIG. 9 is an elevational view, as seen from the right of FIG. 8;

FIG. 10 is a side elevational view of the slide member;

FIG. 11 is an elevational view, as seen from the right of FIG. 10;

FIG. 12 is a front perspective view of the compression means; and

FIG. 13 is a view in side elevation of the FIG. 12 compression means.

DESCRIPTION OF THE PREFERRED EMBODIMENT

The mop has a flat rectangular sponge 10 releasably secured as by screws 12 or the like to each lower face of a pair of flat rectangular, horizontally-disposed, aligned base plates 14 and 16, each being mounted at one end for pivotal movement relative to an adjacent side wall of a horizontally-disposed hub 18 fixed to the lower end of a U-shaped bracket 19 axially aligned with and fixed at its opposite upper end to the lower end of an upstanding cylindrical handle 20. U-shaped bracket 19 opens rearwardly of the mop.

One end of each base plate 14 and 16 has a pair of spaced ears 22 extending outwardly therefrom adjacent the forward and rearward longitudinal faces thereof and receivable in spaced slots 24 provided in each side wall of hub 18 and extending inwardly into the hub from the forward and rearward faces thereof.

A pivot pin 26 passes transversely in a front-to-rear direction through provided openings 28 in ears 23 of each base plate and through an aligned opening 30 adjacent each side wall of hub 18.

Base plates 14 and 16 are mounted relative to hub 18 of handle 20 for movement between a flat or operative position, as shown in FIG. 1, and a folded or face-to-face compressed position, as shown in FIGS. 6 and 7, wherein liquid is extracted from the sponge by a squeezing together of the base plates.

A tubular slide 32 has a hand grip 34 fixed to its upper end and a U-shaped bracket 36 fixed to its lower end, axially aligned therewith, and extending longitudinally downwardly therefrom. The U-shaped bracket opens rearwardly of the mop.

Handle 20 and slide 32 are slidably interengaged, with handle 20 being telescopically sleeved by slide 32 and U-shaped bracket 19 being telescopically sleeved by U-shaped bracket 36 which is complemental thereto.

As aforesaid, both brackets 19 and 36 open to the rear of the mop, for purposes as will appear.

A compression member 38 is of somewhat yoke shape and has a horizontally-disposed U-shaped lower member comprising a cross bar 40 having fingers 42 disposed normal thereto and extending forwardly from each of its ends, with each finger having a cam-like abutment 44 on its free outer end.

A post 46 is fixed at its lower end centrally of the cross bar and extends angularly upwardly and rearwardly from the cross bar.

An opening 48 extends transversely through post 46 adjacent its upper end.

Compression member 38 is mounted for pivotal movement relative to slide 32 and for sliding movement relative to handle 20 by a pivot pin 50 which passes transversely through opening 48 in post 46 of the compression member.

Pivot pin 50 extends outwardly from each side face of post 46 of compression member 38 with each end of pin 50 extending through one of a pair of angularly disposed slots 52 provided in the spaced walls 54 of U-shaped bracket 19 on the lower end of handle 20 and through one of a pair of openings 56 (FIGS. 10 and 11), provided in the spaced walls 58 of U-shaped bracket 36 on the lower end of slide 32.

A head 60 on each free end of pivot pin 50 bears against the outer face of each adjacent wall 58 of U-shaped bracket 36 on slide 32 to hold the pin against lateral movement.

Compression member 38 extends downwardly from the rear of handle 20 so that post 46 and cross bar 40 thereof are disposed rearwardly of and overlying base plates 14 and 16 with fingers 42 of the compression member disposed on either side of hub 18 and with cam like abutments 44 resting in a depression 70 provided on the upper surface of each base plate 14 and 16 adjacent the inner side and rear edges of the base plates. The lower wall of each depression 70 includes an inclined outer end portion 72 which inclines upwardly to merge with the upper face of each base plate.

A longitudinally-extending stop 74 is disposed on the upper surface of each base plate and extends upwardly from the rear edge approximately centrally thereof, for purposes to appear.

When it is desired to extract water from sponge 10, hand grip 34 of slide 32 is grasped in the other hand and handle 20 grasped in the other hand and the slide is slid downwardly relative to the handle, whereupon pivot pin 50 slides downwardly relative to slots 52 of U-shaped bracket 19 to set up a concomitant downward movement of compression member 38, thereby causing the abutments 44 thereof to slide along the depressions 70 in base plates 14 and 16, forcing the base plates to pivot on pins 26 relative to hub 18 in a camming motion to urge the sponge into a U-shaped, folded, or face-to-face position.

Continued downward movement of slide member 32 and the abutments 44 of compression member 38 along inclined portions 72 of depressions 70 causes the base plates 14 and 16 to compress the sponge to extract liquid therefrom.

To return the sponge to normal position, the slide is slid upwardly relative to the handle, to set up concomitant upward movement of compression member 38 and its integral abutments 44 and movement of the abutments relative to depressions 70 thereby releasing the compressive force to permit the base plates 14 and 16 and sponge 10 to return to their normal horizontal positions.

Stops 74 on base plates 14 and 16 preclude abutments 44 of compression member 38 from slipping off of the base plates during such return movement.

We claim:

1. A mop of the "butterfly" type comprising: a handle, a pair of base plates each pivoted at one end to the handle, stops on each base plate, a flat sponge releasably secured to the base plates, a slide member telescopically sleeved on the handle and slidable relative thereto, a yoke-shaped compression member comprising a U-shaped lower member with integral cam-like abutments adapted to bear on the base plates, and an integral post having one end fixed to the lower member and an opposite end mounted for slidable movement relative to the handle and for pivotal movement relative to the slide member, whereby as the slide member is moved in one direction relative to the handle, the yoke-shaped compression member is moved concomitantly therewith with the cam-like abutments acting in a camming motion against the base plates causing the base plates to pivot relative to the handle to force the sponge from a flat position into a U-shaped, folded, or face-to-face position to compress the sponge and extract liquid therefrom, and whereby as the slide member is moved in an opposite direction relative to the handle, the yoke-shaped compression member is moved concomitantly therewith permitting the base plates to pivot relative to the handle and the sponge to return to a flat position, with the stops on the base plates precluding the cam-like abutments from moving out of engagement with the base plates.

2. A mop according to claim 1, wherein the handle and slide member each have integral complemental U-shaped brackets with spaced walls on their lower ends, the slide member bracket being telescopically sleeved in the handle bracket, a pair of aligned slots in the walls of the handle bracket, and a pivot pin extending transversely through the compression member the aligned slots in the handle bracket and the walls of the slide member bracket.

3. A mop according to claim 1, wherein the base plates each have an upper wall with a depression therein, each depression having a lower wall which inclines upwardly to merge with the upper wall, and wherein the U-shaped lower member comprises a cross bar having fingers disposed normal thereto and extending outwardly therefrom, with the cam-like abutments being disposed one on the free outer end of each finger and adapted to ride on the lower wall of the depression in each base plate, with the post having one end fixed centrally of the cross bar and extending angularly upwardly and rearwardly from the cross bar.

* * * * *

UNITED STATES PATENT AND TRADEMARK OFFICE

CERTIFICATE OF CORRECTION

PATENT NO. : 4,831,677

DATED : May 23, 1989

INVENTOR(S) : Keith Morrison et al

It is certified that error appears in the above—identified patent and that said Letters Patent is hereby corrected as shown below:

On title page, at item [73]

change "Bush" to -- Brush --

Signed and Sealed this

Ninth Day of January, 1990

*Attest:*

JEFFREY M. SAMUELS

*Attesting Officer*

*Acting Commissioner of Patents and Trademarks*